US006899361B2

(12) United States Patent
Dorn

(10) Patent No.: US 6,899,361 B2
(45) Date of Patent: May 31, 2005

(54) SELF-LOCKING LATCH AND LOCKING SYSTEM EQUIPPED WITH SAID LATCH

(76) Inventor: Michael Dorn, F-Dorf 61, D-04523 Elstertrebnitz (DE)

( * ) Notice: Subject to any disclaimer, the term of this patent is extended or adjusted under 35 U.S.C. 154(b) by 11 days.

(21) Appl. No.: 10/276,655

(22) PCT Filed: Jun. 8, 2001

(86) PCT No.: PCT/EP01/06537

§ 371 (c)(1),
(2), (4) Date: Nov. 19, 2002

(87) PCT Pub. No.: WO01/94726

PCT Pub. Date: Dec. 13, 2001

(65) Prior Publication Data

US 2003/0155778 A1 Aug. 21, 2003

(30) Foreign Application Priority Data

Jun. 9, 2000 (DE) ..... 100 28 176

(51) Int. Cl.[7] ..... E05B 63/20

(52) U.S. Cl. ..... 292/332; 292/333; 292/335; 70/107; 70/462

(58) Field of Search ..... 70/145, 150, 468, 70/472, 473, 486, 107, 462, 278.7, 283; 292/332, 333, 335, DIG. 25, 252, 137, 347, 334

(56) References Cited

U.S. PATENT DOCUMENTS

| | | | | |
|---|---|---|---|---|
| 92,152 A | * | 7/1869 | Brooks | 70/149 |
| 623,264 A | * | 4/1899 | Sparks | 70/107 |
| 1,169,541 A | * | 1/1916 | Hurd | 70/467 |

(Continued)

FOREIGN PATENT DOCUMENTS

| | | | |
|---|---|---|---|
| DE | 3032086 | * | 3/1982 |
| DE | 3050356 | * | 10/1982 |
| EP | 0 537 531 A | | 4/1993 |
| EP | 0 657 606 A | | 6/1995 |
| EP | 0 668 425 A | | 8/1995 |
| EP | 0 670 404 A | | 9/1995 |

OTHER PUBLICATIONS

European Patent Application, "Self–latching Lock", publication No. 0 670 404 A1, translation of p. 1, Sep. 6, 1995.
European Patent Application, "Lock for Door", publication No. 0 668 425 A1, translation of p. 1, Aug. 23, 1995.
European Patent Application, "Antipanic Lock for Hotel Facilities Which Can Be Actuated by a Key and/or a Door Handle", translation of p. 1, Jun. 14, 1995.
European Patent Abstract, "Door Lock", publication No. 0 537 531 A1, publication date Apr. 21, 1993, 1 page.

*Primary Examiner*—Daniel P. Stodola
*Assistant Examiner*—Carlos Lugo
(74) *Attorney, Agent, or Firm*—Pearne & Gordon LLP

(57) ABSTRACT

A self-latching lock (1) having a bolt (2), a catch (3), an auxiliary catch pin (4) and a reciprocator (5) includes a multi-part latch nut (6) that permits the deactivation of an nut-idling device (8) and thereby a temporary activation of the function of door handles preferably by electrically operated remote-controlled actuation. The latch nut (6) comprises an outer nut body (60) with two arms (61, 62) for operating the catch (3) and the bolt (2), respectively, as well as two hubs (63, 64) each connected with a square section of the outer and the inner door handle and coaxially and rotatably positioned parallel to each other inside the outer nut body (60). The nut-idling device (8) arranged between the hubs (63, 64) and the outer nut body (60) constitutes a coupling which by means of actuators (71, 72) permits disengagement for each hub (63, 54).

11 Claims, 3 Drawing Sheets

U.S. PATENT DOCUMENTS 3,148,525 A * 9/1964 Durant ..... 70/107
3,242,706 A * 3/1966 Check ..... 70/110
3,586,361 A * 6/1971 Ohno ..... 292/169
3,672,714 A * 6/1972 Schultz ..... 292/34
3,769,822 A * 11/1973 Yulkowski ..... 70/107
3,808,849 A * 5/1974 Alexander ..... 70/149
3,890,608 A * 6/1975 Peterson ..... 340/522
4,262,504 A * 4/1981 Inoue ..... 70/151 R
4,569,544 A * 2/1986 Escaravage ..... 292/216
4,583,382 A * 4/1986 Hull ..... 70/107
4,840,050 A * 6/1989 Gotanda ..... 70/107
4,870,841 A * 10/1989 Cudd ..... 70/107
4,890,870 A * 1/1990 Miron ..... 292/333
4,950,005 A * 8/1990 Cudd ..... 292/150
5,083,448 A * 1/1992 Karkkainen et al. ..... 70/277
5,364,139 A * 11/1994 Bergen et al. ..... 292/169
5,469,723 A * 11/1995 Litwin et al. ..... 70/107
5,490,698 A * 2/1996 Dezso ..... 292/138
5,813,255 A * 9/1998 Tell et al. ..... 70/107
5,820,177 A * 10/1998 Moon ..... 292/335
5,890,385 A * 4/1999 Lee ..... 70/472
5,953,942 A * 9/1999 Doucet et al. ..... 70/283
6,049,287 A * 4/2000 Yulkowski ..... 340/693.12
6,145,353 A * 11/2000 Doucet ..... 70/277
6,299,222 B1 * 10/2001 Atmodimedjo ..... 292/144
6,302,456 B1 * 10/2001 Errani ..... 292/332
6,393,878 B1 * 5/2002 Fayngersh et al. ..... 70/107
6,539,755 B1 * 4/2003 Bruwer et al. ..... 70/107

* cited by examiner

SELF-LOCKING LATCH AND LOCKING SYSTEM EQUIPPED WITH SAID LATCH

This invention relates to a self-latching lock and its application in a closure system.

The prior art has produced a number of self-latching locks. For example, the German utility patent 298 12 665.6 describes a self-latching lock whereby, when the door leaf is swung into the door rabbet, the bolt that is cocked in the open position of the door by means of an elastic element snaps into the locked position that cannot be opened from the outside without a key. First, an auxiliary catch pin engages the edge of the strike plate, followed by the entry of the bolt into the strike plate, meaning that in this particular self-latching lock, the bolt will not extend in the full lock-out position until after the catch is fully engaged in the strike plate, thus preventing a premature lock-out extension that might cause damage on the door frame.

This and similar self-latching lock designs, being highly burglar-resistant, are widely used on the outside doors of buildings, apartments and hotel rooms. These doors do not usually have a door handle on the outside, and they can therefore be locked simply by being pushed or pulled shut, and they cannot be opened from the outside without a key.

On the other hand, especially in the case of hotel facilities but also in office buildings, industrial plants, etc., there is a growing trend toward the use of centrally controlled and monitored, partly computer-operated closing systems. By means of sensors installed in the locks, in the door panels or in the door frames and of suitable signal transmission lines or even wireless remote transmission systems, the closure state of all the doors connected to the door-lock control station can be centrally monitored, and it is possible in the same way to use the remotely controllable devices installed in the locks, doors, or door frames to change the closure state of the doors by locking or unlocking them.

However, the existing self-latching lock designs, while being highly intrusion-resistant and therefore lending themselves exceedingly well to installation in outside doors, apartment doors, hotel-room doors, etc., have turned out to be relatively unsuitable for use in combination with existing centrally controlled closure systems, for the following reasons: In the closing systems currently in use, for instance on hotel-room doors, the lock barrel openings are generally covered from the outside, meaning that, there being no door handle, it is not possible by simple manual action to open the door from the outside. The door is instead opened by means of a magnetic card key in conjunction with the traditional door openers located in the strike plate and designed to release the catch. Employing the above-described conventional self-latching locks in combination with the existing closure systems is neither practical nor practicable since from the outside of the door its tumbler could be released only by operating the catch. Without a door handle on the outside of the door, and given that the lock barrel opening is covered, a self-latching lock, once in the full lock-out state, cannot be opened from the outside.

It is for that reason that in conjunction with the conventional closure systems locks without a self-latching feature have been used, which rather severely limits their burglar resistance since the tumbler of a door closed from the outside can be engaged only via the catch.

While in fact for instance DE-197 38 938 A1 describes locks with remotely controlled, electric-motor-driven pawls, these locks are physically complex and expensive and have therefor not so far been employed in closure systems. Electric motors sufficiently strong to move the bolt would take up a great deal of space in the lock, making the production of such locks impossible within the constraints of current standard dimensions and at reasonable cost.

Another possible use of self-latching locks in conventional closure systems could involve the addition of a remotely controllable self-latching inhibitor. Such a self-latching inhibitor could serve, whenever needed, to prevent full lock-out extension of the bolt, for instance when the door was closed from the outside so that, as in the case of locks without a self-latching feature, the door is held locked only via the catch and can be opened from the outside in traditional fashion by means of a magnetic card key and door opener.

That solution, however, does not make much sense because the high intrusion resistance of self-latching locks would not be utilized in the very situation where one leaves the room and closes the door from the outside.

It is therefore the objective of this invention to develop a self-latching lock with a multiparted nut and a coupling between the nut parts which does not need much space and which can be actuated by very little energy. A further objective of the invention is to enhance the remote controllability of self-latching locks by simple, economical means in a way that even in existing, modern closure systems, these locks can fully utilize their burglar-resistant properties. The invention is also aimed at reducing the complexity and cost of installing a centrally controlled closure system.

This invention is explained below in more detail by means of preferred implementation examples and with reference to FIGS. 1 to 3.

Figure 2:
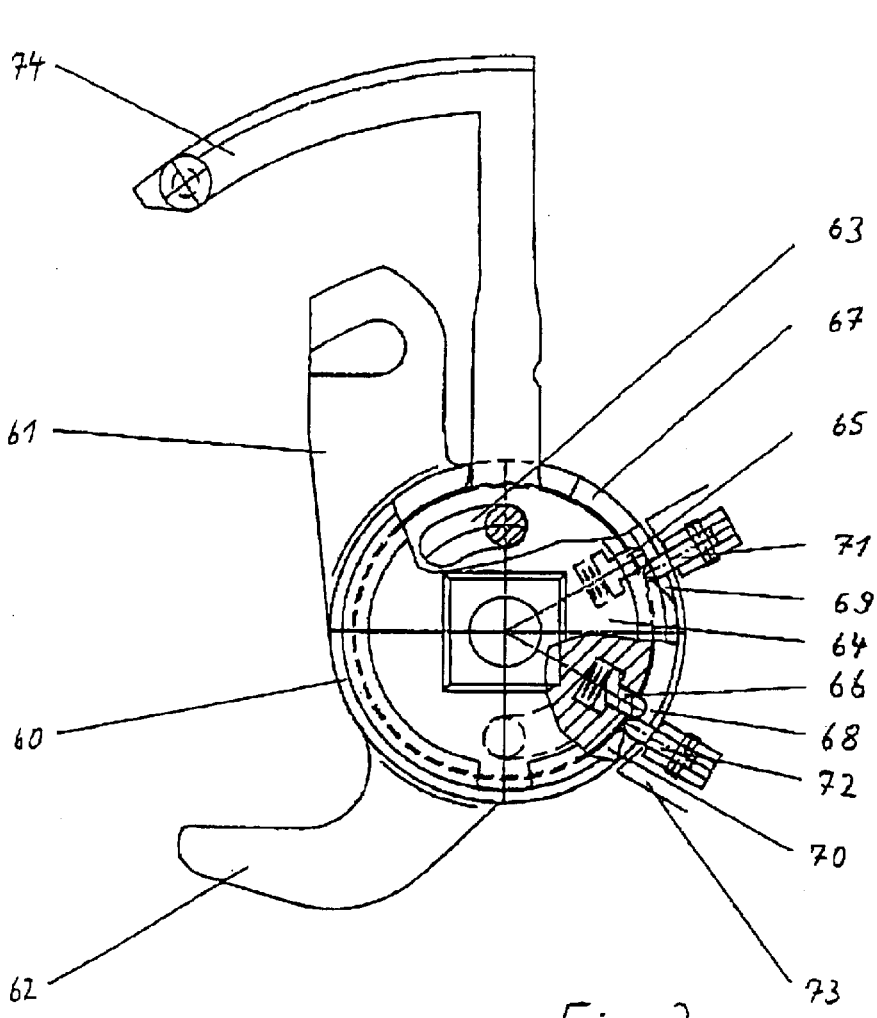
FIG. 2 is a detailed illustration of the nut idling feature required for a lock according to this invention, shown in FIG. 1.
Figure 2A:
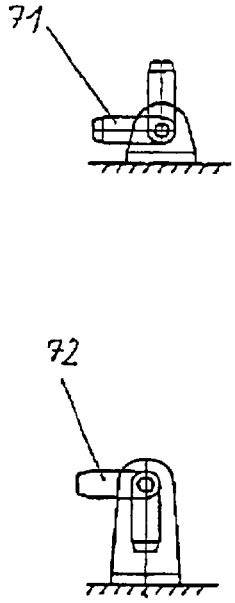
Figure 3:
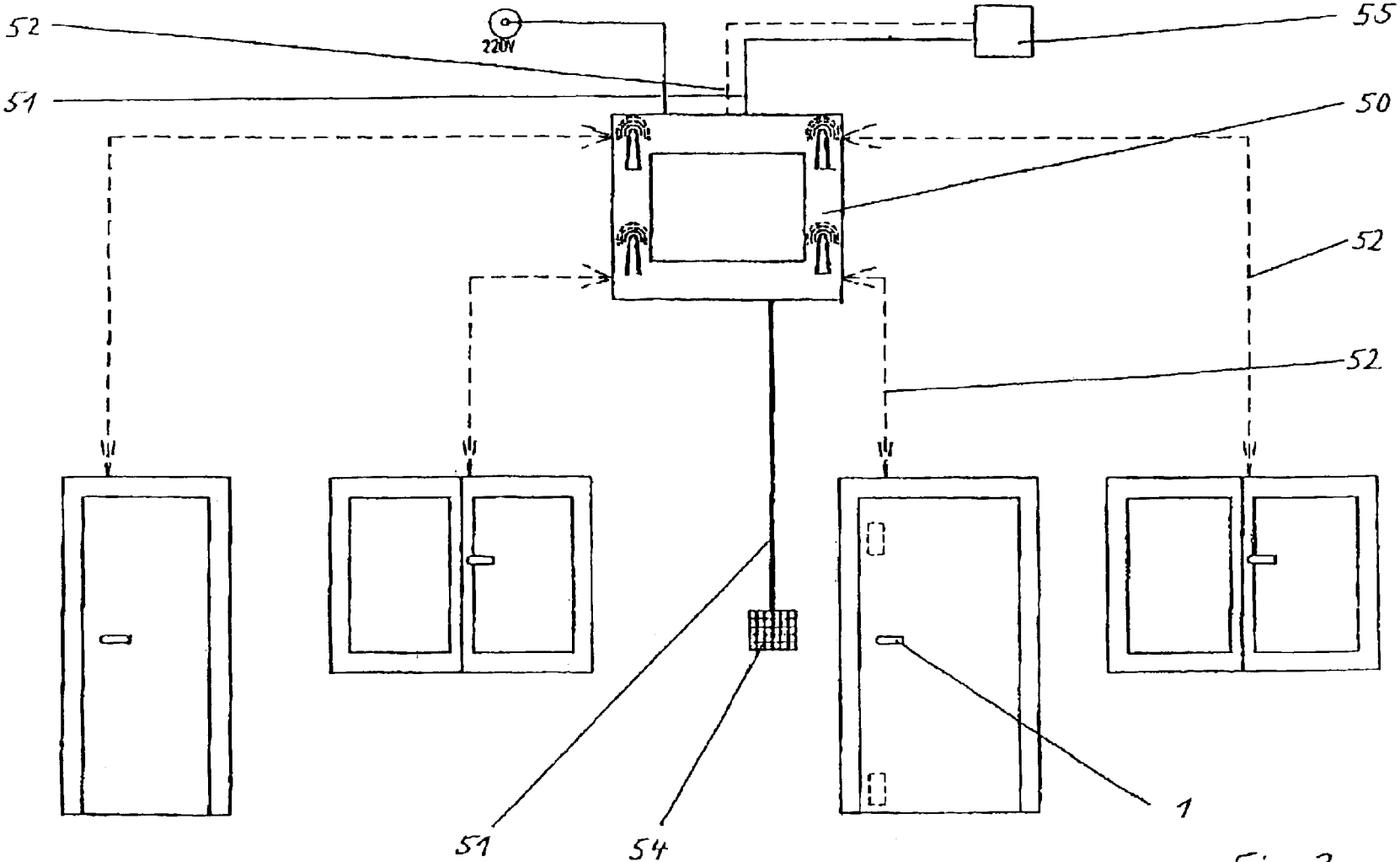

FIG. 2*a* is a lateral aspect of the actuators shown in the top view of FIG. 2;

FIG. 3 shows the schematic layout of a centrally controlled closure system employing locks per this invention.

Figure 1:
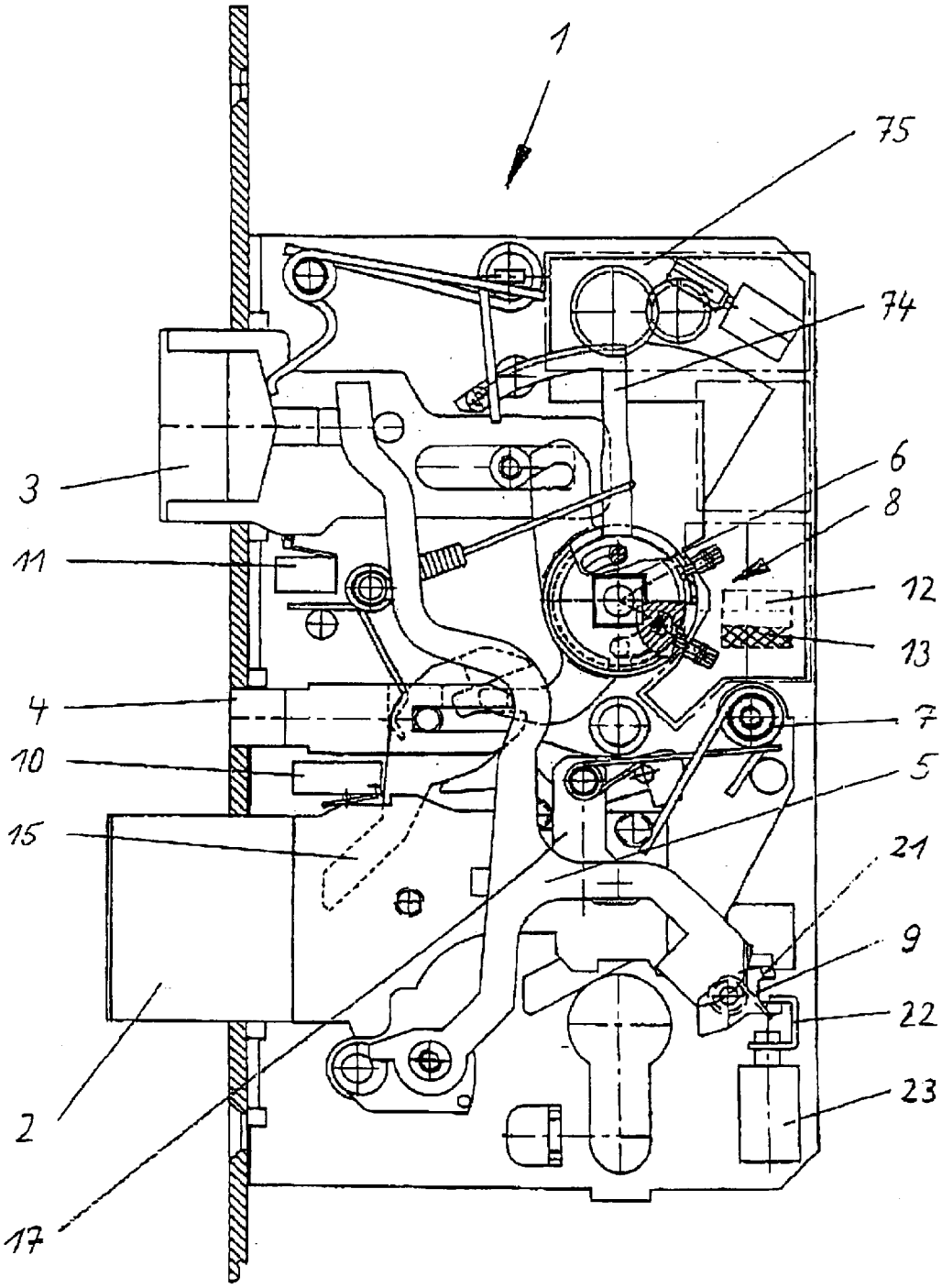
FIG. 1 is a view of a design version of a self-latching lock per this invention, with a nut idling feature and a gear-segment lever-driven generator module for the point-of-use generation of the energy needed to operate the electrical components within the lock.

FIGS. 1 and 2 illustrate an advantageous form of implementation of the invention. In this design version, the function of the latch nut 6 is deactivated, by a nut-idling feature. A remotely controllable coupling makes certain that, whenever the door is to remain in the locked state, the movement of the door handle or door handles on the outside and/or inside of the door cannot be transferred to the latch nut. In the configuration depicted, in FIGS. 1 and 2, and particularly in FIG. 2, this idling function is assured in that the latch nut 6 features an outer nut body 60 with arms 61, 62 for actuating the catch 3 and the bolt 2, respectively. Provided inside the outer nut body 60 in coaxial and parallel fashion are two rotatable hubs 63, 64 for the square sections of the outside and inside door handles. As shown in FIG. 2, round-ended spring-loaded carrier pins 65, 66 protrude radially from the perimeter of each hub 63, 64 and into peripheral tracks 67, 68 recessed into the outer nut body 60, at an angle of about 50 from the vertical. When the door handle is not being operated, the carrier pins 65, 66 are positioned in front of and close to the ends of the peripheral tracks 67, 68, as viewed in the direction of movement of the hubs 63, 64. The peripheral tracks 67, 68 terminate in stops 69, 70, respectively, for the lateral surfaces of the protruding carrier pins 65, 66, respectively. When the door handle is pushed, and after a brief no-load movement, the lateral surface of the corresponding protruding carrier pin 65, 66 strikes against the stop 69, 70, thus carrying the outer nut body 60 along. This movement of the outer nut body 60 and its associated arms 61, 62 causes the catch 3 and the bolt 2 of the self-latching lock 1 per this invention to retract into the open position.

To prevent unauthorized persons from being able to retract the catch 3 and bolt 2 by pushing the door handle, the configuration shown in FIGS. 1, 2 and 2*a* attains the idling function between the door handle and the latch nut in that actuators 71, 72, remote-controllable by an electric signal, are rotated into the space that is created in the home positions of the door handles between the carrier pins 65, 66 and the stops 69, 70. The actuators 71, 72 are situated on a plate on the perimeter of the outer nut body. For a better understanding of their function, the two actuators 71, 72, situated on the plate 73 and visible from the top in FIG. 2, are shown in a lateral aspect in FIG. 2*a*, with the horizontal position of the actuators representing the idling status as illustrated in FIG. 2. Rotating the respective actuator 71, 72 into the space that is created between the carrier pins 65, 66 and the stops 69, 70 when the door handle is in its home position, causes the rounded end of the carrier pins 65, 66 to be pushed back by the slope on the front end of a respective actuator 71, 72, against the action of the compression spring, to a point where any further rotation of the respective hubs 63, 64 moves the front faces of the carrier pins 65, 66 under the inside perimeter of the outer nut body 60, so that the lateral surface of the corresponding carrier pin 65, 66 does not push against the respective stops 69, 70 and the movement of the hubs 63, 64 is not transferred to the outer nut body 60. Consequently, rotating the actuator 71, 72 into said spaces produces an idling function between the associated door handle and the outer nut body 60, preventing any retraction of the catch 3 and the bolt 2. In other words, even when the door handle is pushed the door cannot be opened. Authorized persons, using for instance a magnetic card key, can still move the actuators 71, 72 out of the spaces between the carrier pins 65, 66 and the stops 69, 70, thus deactivating the idling function and allowing the door to be opened.

In desirable fashion, the lock 1 per this invention, illustrated in FIG. 1, is additionally equipped with a gear-segment lever 74 that is permanently coupled to the hubs 63, 64, with the teeth of the gear segment meshing with the drive pinion of a generator 75 that is housed in the lock. Any time the door handle is pushed, whether in the idle mode or for actuating the locking elements, the gear-segment lever 74 causes the generator 75 to produce electric energy that is stored in a buffer, not shown, making the lock 1 in this particular implementation of the invention independent of any external energy source or batteries for assuring its electrical functions. Even if after extended non-use of the door handles the buffer storage unit lacks enough energy for actuating the electrical or electronic components of the lock, pushing the door handle instantly supplies the necessary electric power.

To insure that in a panic situation it is possible at any time to open the door from the inside simply by pushing the door handle without a key, magnetic card or the like, the panic feature is assured in that the actuator 72 is permanently in the neutral, non-rotated state so that the carrier pin 66 of the inside hub 64 always pushes against the stop 70 of the outside nut body and is able to move that. However, it is also possible in certain situations to rotate the actuator 72 between the carrier pin 66 and the stop 70 to intentionally disable the panic feature.

In another desirable design variation of the invention the lock can be additionally equipped with a mechanically and/or electrically operated, and for instance even remotely controllable, inhibitor 9 for selectively disabling the self-latching feature of the self-latching lock 1.

In the design example here described the inhibitor 9 features a detent 21 which, under the action of a spring 22, engages in a recess in the bolt 2 when the bolt is in the open position, holding the bolt in that open position. The inhibitor 9 can be disengaged for instance by a remotely controlled lifting or pull-type electromagnet 23 which, as shown in FIG. 1, rotates the detent 21 of the inhibitor 9 out of the recess in the bolt.

The ability to centrally remote-control the inhibitors 9 for instance in emergency situations with simultaneous central deactivation of the nut-idling devices 8 makes it possible to allow all doors to be opened from the outside as well.

In an advantageous form of implementation of this invention, at least one moving part of the lock, especially the bolt 2 and/or the catch 3 and/or the auxiliary catch pin 4 is/are provided with a sensor or several sensors 10, 11 allowing the determination of the position of the moving part(s) at any given time.

For further processing, that positional information can be fed to a remote central station or to a control unit 12 located in the lock 1 and serving to control the electrically operated devices such as the nut-idling device 8 or the inhibitor 9 for the self-latching feature. The data transmission system may be hard-wired or wireless. For wireless transmission a transceiver unit 13 is provided, possibly integrated into the control unit 12. The transceiver unit 13 may be of the radio-operated type.

In a desirable design version of the invention, the lock-out function of the bolt 2 additionally depends on the entry of the catch 3 into the strike plate. This prevents premature dead-bolt extension of the bolt that might otherwise damage the door frame or the strike plate.

To dampen the clicking sound when the bolt snaps into its lock-out position, at least one of bolt guides, i.e. either a bolt guide pin or a rear end of a bolt guide slot may include an elastic sound attenuator.

In addition, in order to increase the counteracting force of the bolt for further enhanced break-in resistance, the bolt guide pin that connects to the lock case may be linked via a bridge element 17 to another lock segment that is connected to the lock case, or directly to the lock case itself.

FIG. 3 is a schematic illustration of a closure configuration according to this invention, employing self-latching locks per the invention and a central control system 50.

In the implementation example illustrated, at least all of the doors in the building concerned are equipped with self-latching locks 1 per this invention and are in a constantly locked state by way of the nut-idling device 8 and the fully extended bolt 2. A code scanner 54 next to the door (FIG. 3 shows such a code scanner 54 only next to the main entrance door) in combination with the central control system 50 allows an authorized person to deactivate the nut-idling device 8, enabling that authorized person, by pushing the outside door handle, to retract the catch 3 and, via the release lever 15, the bolt 2. A one-time scan by the code scanner releases the nut-idling device 8 for only a one-time opening of the door. When the door is closed again, the nut-idling device 8 and the self-latching bolt 2, controlled by the central control unit, are promptly reactivated, which secures the building in previously unattainable fashion against break-in.

In the implementation example Illustrated, the code scanner 54 is hard-wired to the central control unit 50 while the return signal from the control unit to the lock in the main entrance door is transmitted via a wireless link. Of course, the connections may be made in any suitable fashion, for instance all wireless.

The central control unit 50 is programmed or manually controlled via the control panel 55 which on its part is connected to the central control unit 50 either through lines 51 or wireless links 52.

Based on this invention, it is now possible in simple fashion to employ even self-latching locks in a modern closure system, which can significantly improve the intrusion protection of buildings secured by centrally controlled closure systems.

Moreover, it is now possible to do without the traditionally used door openers that are installed in the strike plate or in the door frame, offering little security, including their relatively complex installation.

What is claimed is:

1. A self-latching lock (1) comprising a bolt (2), a catch (3), an auxiliary catch pin (4) and a reciprocator (5), in which the bolt (2) that can be operated via a latch nut (6) or a closing thruster is preloaded, when a door is open, by an elastic element (7) for a locking action and, when a door leaf is engaged in a door rabbet, is released into its locking position by an action of at least the auxiliary catch pin (4), said latch nut (6) is multipart and permits a deactivation of a nut-idling device (8) and thereby a temporary activation of the function of outer and inner door handles by an electrically operated remote-controlled actuation, the multipart latch nut (6) comprises an outer nut body (60) with two arms (61, 62) for operating the catch (3) and the bolt (2), respectively, as well as two hubs (63), 64), each connected with a square section of the outer and inner door handle and coasially and rotatably positioned parallel to each other inside the outer nut body (60), and the nut-idling device (8) constitutes a coupling between the hubs (63, 64) and the outer nut body (60) which by means of actuators (71, 72) permits disengageent for each hub (63, 64), the coupling between the hubs (63, 64) and the outer nut body (60) includes in each hub a carrier pin (65, 66) with a rounded end, radially protruding outward in spring-loaded fashion from the hub into a respective one of tracks (67, 68) recessed into the perimeter of the outer nut body (60) by an angle of about 50° and extending close to a respective one of stop-shaped ends (69, 70) of the recessed track (67, 68) and that the coupling is deactivated by engagement of the actuators (71, 72), with a sloped front side opposite the rounded end of a respective carrier pin, in a respective interstitial space between the stops (69, 70) and the carrier pins (65, 66) that pushes the carrier pins back into the hub (63, 64) when the hub is moved.

2. A self-latching lock (1) as in claim 1, characterized by a segment lever (74) that is permanently coupled to the hubs (63, 64) for driving an electric generator mounted inside the lock (1).

3. A self-latching lock (1) as in claim 1, characterized in that at least for one of the bolt (2), the catch (3) and the auxiliary catch pin (4) at least one sensor (10, 11) is provided for detecting its position at any given time.

4. A self-latching lock (1) as in claim 1, characterized in that the lock (1) incorporates at least one control unit (12) for controlling the electrically operated elements of the lock under interpretative utilization of the signals captures by the sensor(s) (10, 11) and in response to instructions sent to a control unit (12) from outside the lock.

5. A self-latching lock (1) as in claim 4, characterized in that the control unit (12) is connected to a transceiver (13) inside the lock for the purpose of receiving and forwarding wirelessly transmitted signals.

6. A self-latching lock as in claim 5, characterized in that the transceiver unit (13) is a radio transceiver.

7. A self-latching lock as in claim 1, characterized in that lock-out extension of the bolt (2) is additionally dependent on the entry of the catch (3) and a strike plate.

8. A self-latching lock as in claim 1, characterized in that a bolt guide element connected to the lock case is linked via a bridge element (17) to another lock segment that is connected to the lock case, or is linked to the lock case itself.

9. A self-latching lock (1) as in claim 1, characterized in that the bolt (2) is provided with an inhibitor (9) serving to temporarily disable the self-latching function.

10. A self-latching lock (1) as in claim 9, characterized in that the inhibitor (9) is operated by at least one of mechanical and electrical means and remotely controllable.

11. A self-latching lock (1) as in claim 1, characterized in that the lock is connected via at least one of hardwired lines (51) and wireless links (52) to a central control system (50) and to other, additional locks on lockable openings of a building.

* * * * *

UNITED STATES PATENT AND TRADEMARK OFFICE

CERTIFICATE OF CORRECTION

PATENT NO. : 6,899,361 B2
DATED : May 31, 2005
INVENTOR(S) : Michael Dorn

It is certified that error appears in the above-identified patent and that said Letters Patent is hereby corrected as shown below:

Title page,
Item [57], ABSTRACT,
Line 15, please delete "54)", and insert -- 64) --.

Column 2,
Line 60, please delete "50", and insert therefor -- 50° --.

Column 5,
Line 31, please delete "(63), 64)", and insert therefor -- (63, 64) --.
Line 33, please delete "coasially", and insert therefor -- coaxially --.
Line 37, please delete "disengageent", and insert therefor -- disengagement --.

Signed and Sealed this

Sixth Day of September, 2005

JON W. DUDAS
*Director of the United States Patent and Trademark Office*